US012022987B2

(12) United States Patent
Huang et al.

(10) Patent No.: US 12,022,987 B2
(45) Date of Patent: Jul. 2, 2024

(54) WATER TANK AND CLEANING ROBOT

(71) Applicant: SHENZHEN FLY RODENT DYNAMICS INTELLIGENT TECHNOLOGY CO., LTD, Shenzhen (CN)

(72) Inventors: Shusheng Huang, Shenzhen (CN); Jianya Li, Shenzhen (CN); Linlin Zhou, Shenzhen (CN); Wenhai Deng, Shenzhen (CN); Changtai Xia, Shenzhen (CN); Ruijun Yan, Shenzhen (CN)

(73) Assignee: SHENZHEN FLY RODENT DYNAMICS INTELLIGENT TECHNOLOGY CO., LTD., Shenzhen (CN)

( * ) Notice: Subject to any disclaimer, the term of this patent is extended or adjusted under 35 U.S.C. 154(b) by 40 days.

(21) Appl. No.: 17/164,011

(22) Filed: Feb. 1, 2021

(65) Prior Publication Data

US 2022/0079408 A1 Mar. 17, 2022

(30) Foreign Application Priority Data

Sep. 11, 2020 (CN) ..... 202010955788.7

(51) Int. Cl.
*A47L 11/40* (2006.01)
*B25J 11/00* (2006.01)

(52) U.S. Cl.
CPC ..... *A47L 11/4083* (2013.01); *A47L 11/4088* (2013.01); *A47L 2201/00* (2013.01)

(58) Field of Classification Search
CPC ..... A47L 2201/00; A47L 2201/024; A47L 2201/026; A47L 2201/06; A47L 11/4013;
(Continued)

(56) References Cited

U.S. PATENT DOCUMENTS 11,096,536 B2 * 8/2021 Yang ..... A47L 11/4094
11,219,344 B2 * 1/2022 Ko ..... A47L 13/502
(Continued)

FOREIGN PATENT DOCUMENTS

CN 107456165 * 12/2017 ..... A47L 11/28
CN 207055441 U 3/2018
(Continued)

OTHER PUBLICATIONS

PE2E Translation of CN107456165; Zhang, Xue-dong, Dec. 12, 2017, p. 1-8 (Year: 2017).*
(Continued)

*Primary Examiner* — Laura C Guidotti
*Assistant Examiner* — Sidney D Full
(74) *Attorney, Agent, or Firm* — Samson G. Yu

(57) ABSTRACT

The disclosure discloses a water tank and a cleaning robot, the water tank is applied to the cleaning robot, internally provided with a water storage cavity. The water tank has a splicing side, the splicing side is provided with an accommodating area recessed towards the inside of the water tank, the splicing side of the water tank is configured to splice with the body of the cleaning robot, and the accommodating area is configured to accommodate part of the structural parts of the body of the cleaning robot.

15 Claims, 5 Drawing Sheets

(58) Field of Classification Search
CPC ..... A47L 11/4083; A47L 11/4088; A47L 9/1683; A47L 9/1691; A47L 11/24; A47L 11/28; B25J 11/0085
See application file for complete search history.

(56) References Cited

U.S. PATENT DOCUMENTS

| | | | | |
|---|---|---|---|---|
| 2007/0212035 | A1 | 9/2007 | Oh | |
| 2009/0044351 | A1* | 2/2009 | Menrik | A47L 11/4088 15/21.1 |
| 2010/0199454 | A1* | 8/2010 | Pruitt | A47L 5/38 15/301 |
| 2018/0084963 | A1* | 3/2018 | Lim | A47L 9/106 |
| 2019/0290089 | A1* | 9/2019 | Johnson | A47L 11/305 |

FOREIGN PATENT DOCUMENTS

| | | | | | |
|---|---|---|---|---|---|
| CN | 108433654 | A | * | 8/2018 | A47L 11/282 |
| CN | 108451447 | A | | 8/2018 | |
| CN | 108451448 | A | | 8/2018 | |
| CN | 108852185 | A | * | 11/2018 | A47L 11/24 |
| CN | 209932603 | U | | 1/2020 | |
| CN | 211324779 | U | | 8/2020 | |
| WO | 2022052385 | A1 | | 3/2022 | |

OTHER PUBLICATIONS

CN-108852185 WIPO Translation; Water Tank and Automatic Cleaning Device; Li, Xing; Nov. 23, 2018 (Year: 2018).*
CN-108433654 WIPO Translation; A Water Tank and a Cleaning Device with It; Tang, L; Aug. 24, 2018 (Year: 2018).*

* cited by examiner

WATER TANK AND CLEANING ROBOT

CROSS-REFERENCE TO RELATED APPLICATIONS

This application is based upon and claims priority to Chinese Patent Application CN202010955788.7, filed on Sep. 11, 2020, the entire contents of which are incorporated herein by reference.

TECHNICAL FIELD

The disclosure relates to the technical field of intelligent cleaning equipments, in particular to a water tank and a cleaning robot.

BACKGROUND

A cleaning robot is mainly used to do cleaning work at home in substitution of human. The cleaning robot comprises a body which a water tank is mounted on and at the bottom of which a mop is mounted. The water tank is used to supply water to the mop for ground cleaning.

However, there are many structures in the body of the traditional cleaning robot, so that there is not much space outside for the mounting of the water tank. Therefore, in order to match the model of the cleaning robot, the water tank in the market is made smaller so that it can be mounted on the body of the cleaning robot. However, in this way, the volume of the water tank is greatly reduced.

SUMMARY

There are provided a water tank and a cleaning robot according to embodiments of the present disclosure.

According to an aspect of embodiments of the present disclosure, there is provided a water tank. The water tank is applied to the cleaning robot, internally provided with a water storage cavity. The water tank has a splicing side, the splicing side is provided with an accommodating area recessed towards the inside of the water tank, the splicing side of the water tank is configured to splice with the body of the cleaning robot, and the accommodating area is configured to accommodate part of the structural parts of the body of the cleaning robot.

According to another aspect of embodiments of the present disclosure, there is provided a cleaning robot. The cleaning robot comprises a body and a water tank. The water tank is applied to a cleaning robot, internally provided with a water storage cavity. The water tank has a splicing side, the splicing side is provided with an accommodating area recessed towards the inside of the water tank, the splicing side of the water tank is configured to splice with the body of the cleaning robot, and the accommodating area is configured to accommodate part of the structural parts of the body of the cleaning robot. The water tank is spliced with the body of the cleaning robot.

BRIEF DESCRIPTION OF THE DRAWINGS

In order to explain the technical solutions of the embodiments of the present disclosure or the prior art more clearly, the following will briefly introduce the drawings that need to be used in the description of the embodiments or the prior art. Obviously, the drawings in the following description are only some embodiments of the present disclosure. For those of ordinary skill in the art, without any creative work, other drawings can be obtained according to the structure shown in these drawings.

DESCRIPTION OF REFERENCE NUMBER

Figure 1:
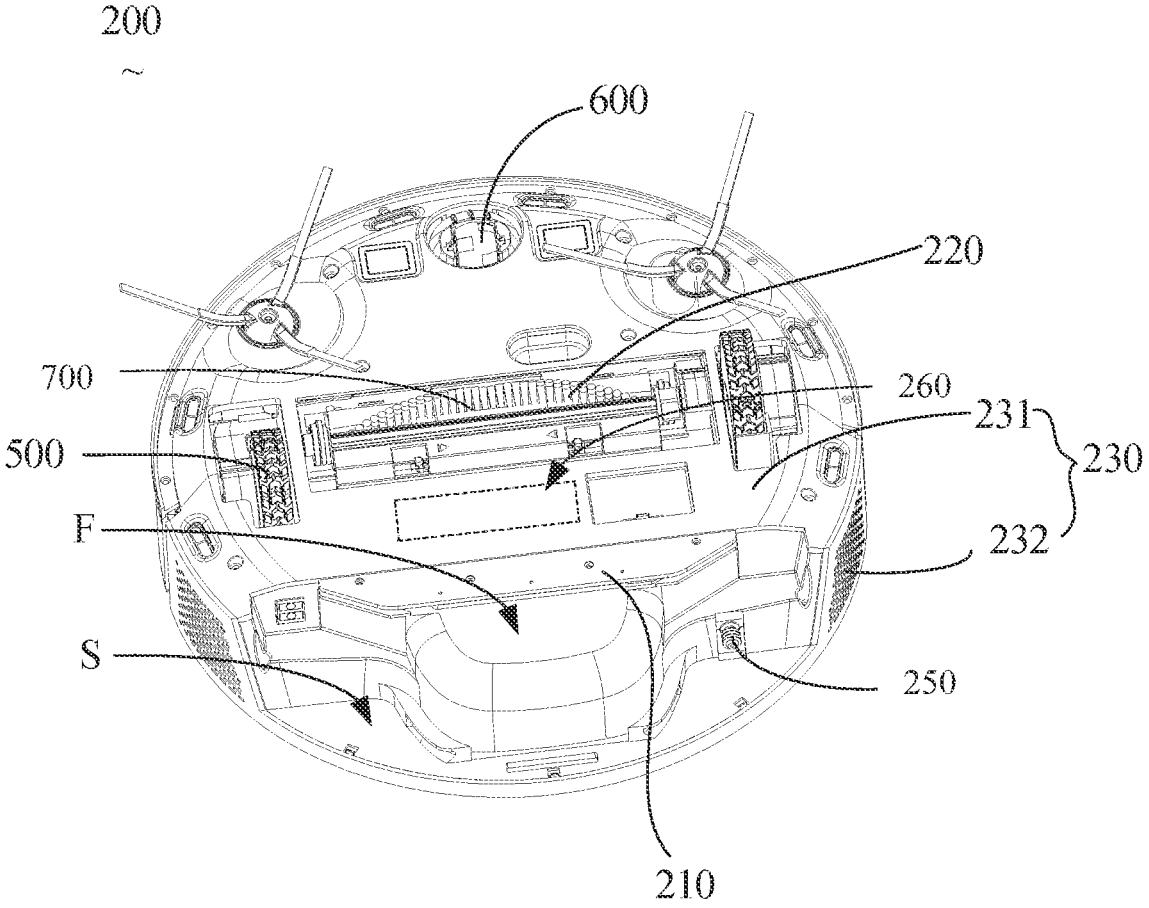
FIG. 1 is a schematic structural diagram of the cleaning robot of the present disclosure in the bottom view.

| reference number | name | reference number | name |
|---|---|---|---|
| 200 | Cleaning robot | 210 | Fluid applicator |
| 220 | Pipe | 230 | Body |
| 231 | Chassis | 232 | Upper cover assembly |
| 400 | Water tank | 401 | Bottom plate |
| 402 | Housing | 410 | Rubber plug |
| 420 | Outlet valve | 430 | Main water storage cavity |
| 440 | Secondary water storage cavity | 441 | Longitudinal water storage space |
| 442 | Transversal water storage space | 450 | Water transporting mechanism |
| 460 | Mounting reinforcement part | 470 | Recessed portion |
| 480 | Guide Mounting block | 500 | Driving wheel |
| 600 | Omni-directional wheel | 700 | Middle sweep brush |
| R | Accommodating area | P | Splicing side |
| C | Side surface | Z | Support member |
| $Q_1$ | Lowest horizontal plane area | $Q_2$ | Inclined diversion area |

The realization, functional characteristics and advantages of the present disclosure will be further described in conjunction with the embodiments and with reference to the accompanying drawings.

DETAILED DESCRIPTION

The technical solutions in the embodiments of the present disclosure will be clearly and completely described below in conjunction with the accompanying drawings in the embodiments of the present disclosure. It could be understood that the described embodiments are only some of embodiments of the present disclosure, rather than all the embodiments. Based on the embodiments of the present disclosure, all other embodiments obtained by those of ordinary skill in the art without creative work shall fall within the scope of the present disclosure.

It should be noted that all the directional indications (such as up, down, left, right, front, back . . . ) in the embodiments of the present disclosure are only used to explain the relative positional relationship, movement, etc. between the components in a specific posture (as shown in the figure). If the specific posture changes, the directional indication will change accordingly.

In addition, the descriptions related to "first" and "second" in the application are only used for descriptive purposes, and cannot be understood as indicating or implying relative importance or implicitly indicating the number of indicated technical features. Therefore, the features defined with "first" and "second" may explicitly or implicitly comprise at least one of the features. In addition, the technical solutions between the various embodiments can be combined with each other, but they must be based on what can be achieved by a person of ordinary skill in the art. When the combination of technical solutions is contradictory or cannot be achieved, it should be considered that the combination of such technical solutions does not exist, and does not fall within the scope of the present disclosure.

The embodiment of the application provides a cleaning robot 200, including a body and a water tank 400, which can be spliced with the body of the cleaning robot 200.

It can be understood that the cleaning robot 200 can be a sweeping robot, a sweeping and mopping integrated robot, a floor cleaning robot, a window cleaning robot, a hand-held vacuum cleaner or a hand-push cleaning machine, etc., which are not limited herein.

The shape of the body 230 of the cleaning robot 200 is not limited, such as a circle, a square, an ellipse, a triangle, or a polygon. In this embodiment, explanation is made by assuming that the shape of the body 230 of the cleaning robot 200 is a circle.

Referring to FIG. 1, the cleaning robot 200 comprises a body 230. The body 230 may comprise a chassis 231 and an upper cover assembly 232. The upper cover assembly 232 is detachably mounted on the chassis 231 to protect the various functional components inside the cleaning robot 200 from violent impact or accidental dripping of liquid during use; the chassis 231 and/or the upper cover assembly 232 are used to carry and support various functional components. In an alternative embodiment, the body 230 of the cleaning robot 200 may also be other design structures. For example, the body 230 is an integrally formed structure or a left and right separated structure. The material, shape, structure, etc. of the body 230 are not limited in the embodiments of the present disclosure. The inner cavity is formed between the chassis 231 and the upper cover assembly 232, and used to provide an arrangement space for the internal components of the cleaning robot 200. The cleaning robot 200 may be provided with a vacuum pump, a circuit board, a ground detection sensor, a collision detection sensor, a wall-following sensor, etc. in the inner cavity.

The cleaning robot 200 may be designed to autonomously plan a path on the ground, or it may be designed to move on the ground in response to a remote control command. In the embodiment of the present application, the cleaning robot 200 comprises a walking mechanism mounted on the chassis 231, and the walking mechanism comprises two driving wheels 500, and at least one omni-directional wheel 600. The two driving wheels 500 and the omni-directional wheel 600 at least partially protrude from the bottom of the chassis 231. For example, under the action of its own weight of the cleaning robot 200, the two wheels can be partially hidden inside the chassis 231. In an alternative embodiment, the walking mechanism may also comprise any one of triangular crawler wheels, mecanum wheels, and the like.

The cleaning robot 200 may comprise a cleaning assembly that is detachably connected to the body 230 of the robot 200. The cleaning assembly comprises a middle sweep brush assembly. The middle sweep brush assembly comprises at least one middle sweep brush 700. The at least one middle sweep brush 700 can be arranged in a receiving groove opened at the bottom of the chassis 231, and a dust suction port is opened in the receiving groove. The dust suction port is communicated with a dust collecting box and a dust suction fan, so that when the middle sweep brush rotates, the dust and debris on the ground are stirred up, and the dust and debris are sucked into the dust collecting box from the dust suction port by the suction force of the dust suction fan.

Figure 8:
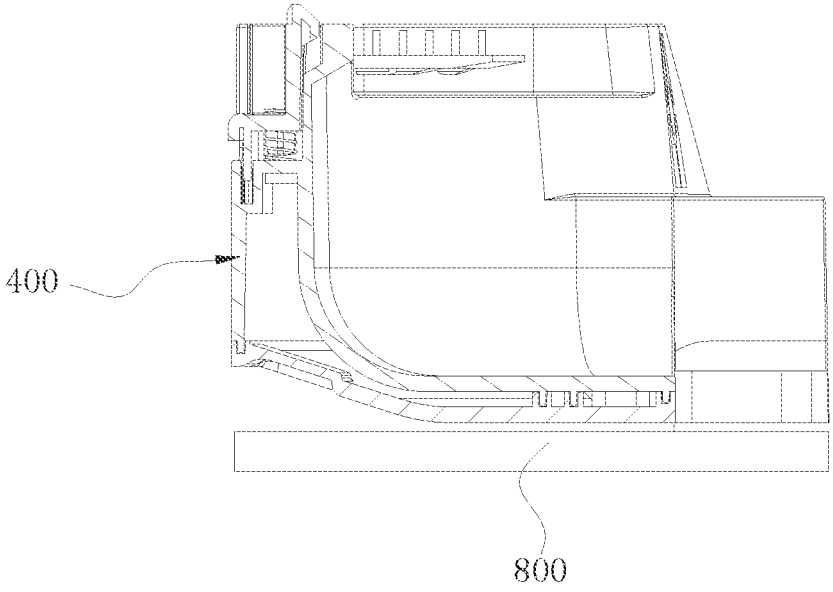
FIG. 8 is a cross-sectional view of the water tank and a mopping assembly.

Referring to FIG. 8, the cleaning robot 200 further comprises a mopping assembly 800, which is detachably connected to the bottom of the water tank 400.

Referring to FIG. 1, FIG. 1 shows a bottom view of the cleaning robot 200. The body 230 of the cleaning robot 200 is equipped with a fluid applicator 210 at the bottom, and the fluid applicator 210 is provided with a branch channel. The cleaning robot 200 is also equipped with a water pumping device 260 communicated with the fluid applicator 210. The water pumping device 260 pumps the liquid in the water tank 400 to the fluid applicator 210. The flow channel divides the liquid flowing into the fluid applicator 210 to various areas of the fluid applicator 210 to ensure that the liquid can fully wet the entire mop during the work of the cleaning robot 200.

A fan is mounted inside the cleaning robot 200. The area indicated by F in FIG. 1 is a mounting area. The body of the cleaning robot 200 is provided with a carrying structure corresponding to the mounting area, and the carrying structure can carry the fans arranged in the mounting area. It should be noted that, the carrying structure may not be arranged in the middle of the body of the cleaning robot 200, but may also be arranged on the side. In addition, the mounting area is not limited to the mounting of the fan, and other structures in the body of the cleaning robot 200 may also be mounted. Due to the large space occupied by the carrying structure, the water tank 400 needs to be improved to match the structure of the body 230 of the cleaning robot 200. The body of the cleaning robot 200 is also provided with a splicing groove at least partially surrounding the carrying structure. The water tank 400 is detachably mounted in the splicing groove, as indicated by S in the figure.

Figure 2:
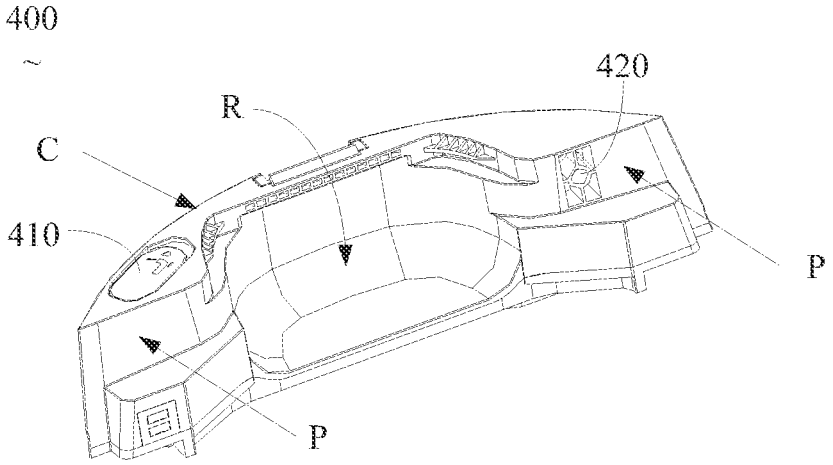
FIG. 2 is a schematic structural diagram of an water tank of an embodiment of the present disclosure.

Please refer to FIG. 2 for details. FIG. 2 shows a schematic diagram of an implementation structure of the water tank 400. The structure of the water tank 400 may be an integral structure, or be assembled by split structures. Taking being assembled by split structures as an example, the water tank 400 comprises a bottom plate 401 and a housing 402 (as shown in FIG. 5). The bottom plate 401 and the housing 402 enclose together to form the water tank 400, and the water tank 400 comprises a water storage cavity inside. As shown in FIG. 2 or FIG. 4*b*, the water tank 400 comprises a splicing side P to be assembled with the body of the cleaning robot 200 and a side surface C opposite to the splicing side P. The other two sides of the water tank 400 correspond to the vertical direction of the cleaning robot 200. In order to assemble with the carrying structure of the cleaning robot 200, the splicing side P of the water tank 400 is provided with an accommodating area R recessed towards the inside of the water tank 400. When the water tank 400 is mounted on the body of the cleaning robot 200, the splicing side P of the water tank 400 is spliced with the body 230 of the cleaning robot 200, and the accommodating area R accommodates the carrying structure of the body 230 of the cleaning robot 200. Alternatively, the side surface C of the water tank 400 smoothly transits to the side surface of the body 230 of the cleaning robot 200. It is understood that the side surface of the body of the cleaning robot 200 is adjacent continuously with the side surface C of the water tank 400, which makes the overall structure more compact and beautiful. In addition, the side surface C of the water tank 400 is arc-shaped, so it is more integrated with the body 230 of the cleaning robot 200.

The position of the accommodating area R corresponds to the position of the carrying structure of the cleaning robot 200. When the carrying structure is arranged in the middle of the body 230 of the cleaning robot 200, the accommodating area R is correspondingly recessed and arranged in the middle of the water tank 400. When the carrying structure is arranged on the side of the body of the cleaning robot 200, the accommodating area R is correspondingly recessed and arranged at the side of the water tank 400. In addition, there may be a continuous wall around the recess of the accommodating area R, or the top of the accommodating area R may be penetrated to form an opening, or the bottom of the accommodating area R may be penetrated to form an opening. FIG. 2 shows a scheme in which an opening is arranged on the top of the accommodating area R.

Please continue to refer to FIG. 2, the water tank 400 is also provided with a water feeding port, and the water feeding port is sealed by a rubber plug 410. Users may add water to the water tank 400 by removing the rubber plug 410. The water tank 400 is also provided with an outlet valve 420, and the pumping device 260 of the cleaning robot 200 is communicated with the outlet valve 420 to extract the liquid in the water tank 400. The water pumping device 260 comprises a pumping pipe 220 and a pump (such as a peristaltic pump). The outlet valve 420 has a water outlet pipe 250, and the pumping pipe 220 of the pumping device 260 is inserted into the water outlet pipe 250 of the outlet valve 420 to trigger the opening of the outlet valve 420. A sealing member can be arranged between the outlet valve 420 and the pumping pipe 220 to improve sealing property. For example, a sealing plug is placed around the pumping pipe 220, and when the pumping pipe 220 is inserted into the water outlet pipe 250 of the outlet valve 420, the sealing plug is arranged in the water outlet pipe 250 with an interference fit. In addition, the cooperation between the pumping pipe 220 and the outlet valve 420 may improve the stability and firmness of the water tank 400 mounted on the body of the cleaning robot 200.

Figure 3:
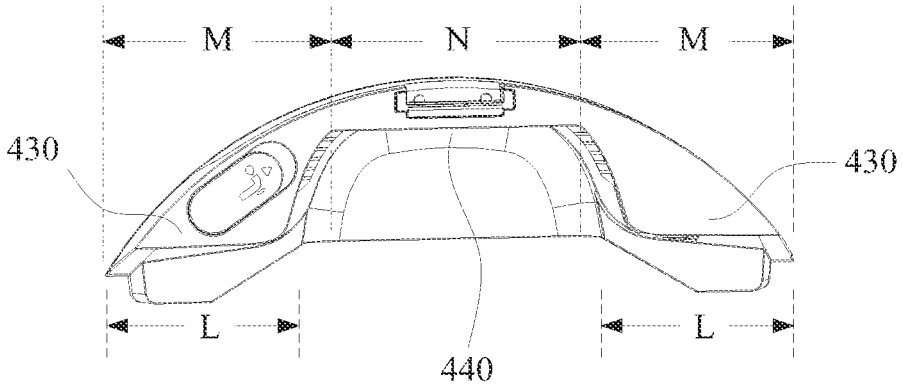
FIG. 3 is a schematic structural diagram of the water tank in FIG. 2 in the top view.

Referring to FIG. 2 and FIG. 3, due to the arrangement of the accommodating area R, water tank 400 is roughly divided into three areas, and the three areas include a narrower middle area N and wider side areas M on both sides. Correspondingly, the water storage cavity of the water tank 400 comprises two main water storage cavities 430 on opposite sides of the accommodating area R and a secondary water storage cavity 440 corresponding to the accommodating area R and communicating with the two main water storage cavities 430. The water storage space of the main water storage cavity 430 on both sides is larger than that of the secondary water storage cavity 440. Therefore, the water tank 400 with the above-mention structure not only guarantees the water storage capacity of the water tank 400 to be large enough, but also provides accommodating area on the premise of including two large volume main water storage cavities 430.

Figure 4A:
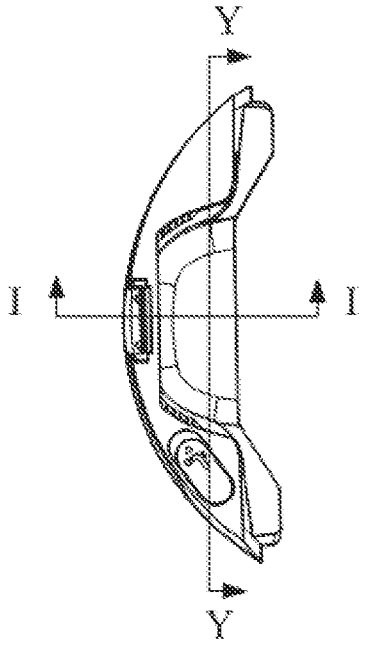
FIG. 4*a* is a view of the water tank in FIG. 3 after being rotated 90° counterclockwise.
Figure 4B:
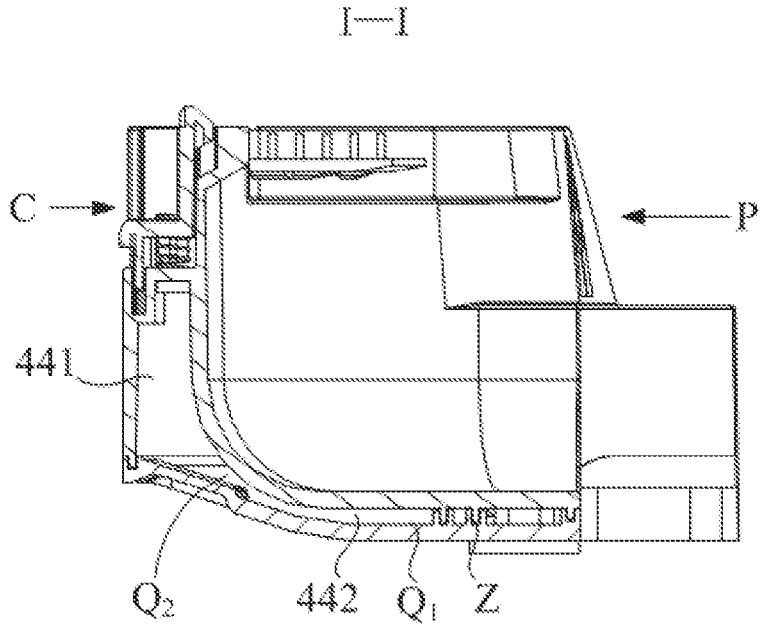
FIG. 4*b* is a cross-sectional view along line I-I in FIG. 4*a;*
Figure 4C:
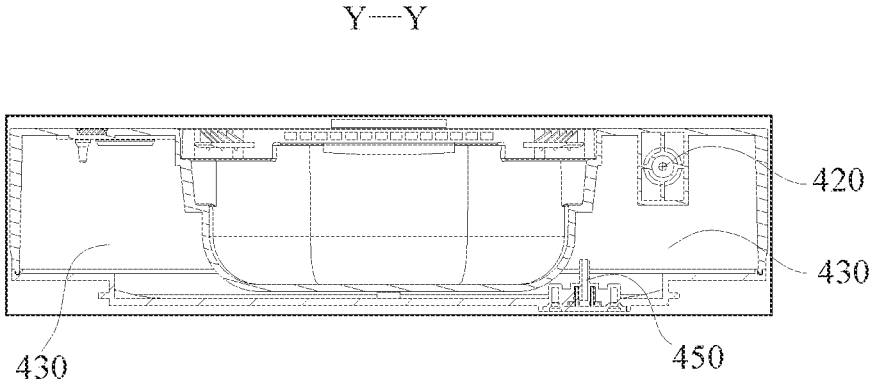
FIG. 4*c* is a cross-sectional view along line Y-Y in FIG. 4*a;*
Figure 5:
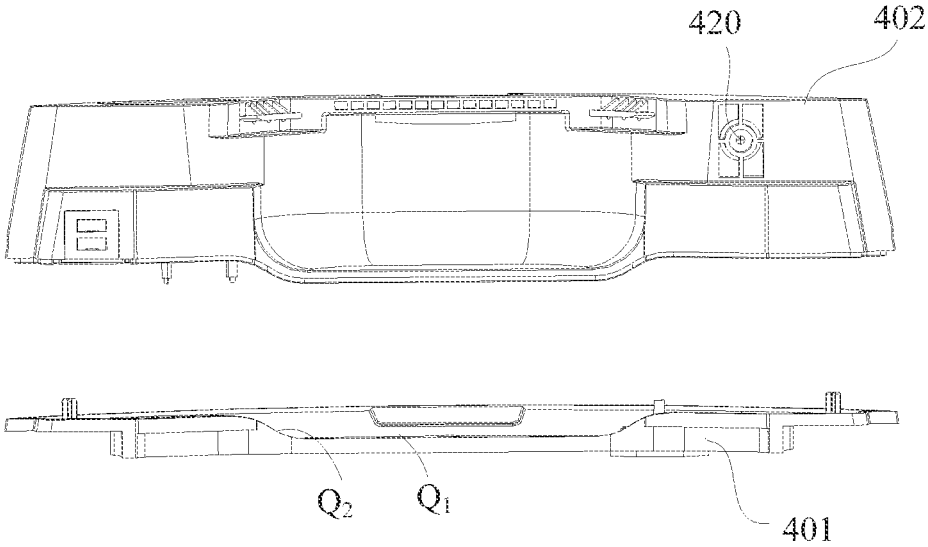
FIG. 5 is an exploded structural diagram of the water tank of another embodiment of the present disclosure.

Further, please refer to FIG. 4A and FIG. 4B. FIG. 4*b* is a cross-sectional view of the water tank 400 in FIG. 4A along the line I-I. The secondary water storage cavity 440 includes a longitudinal water storage space 441 and a transversal water storage space 442. The longitudinal water storage space 441 is adjacent to the side of the accommodating area R, the transversal water storage space 442 is adjacent to the bottom of the accommodating area R, and the width of the cross-section of the longitudinal water storage space 441 is greater than that of the transversal water storage space 442. It is easy to understand that considering the height of the carrying structure is large, the accommodating area R also needs to be set with a large height correspondingly. The bottom of the accommodating area R contacts the bottom of the carrying structure. If the cross-sectional width of the transversal water storage space 442 is arranged to be larger, the height of the water tank 400 will be further increased, resulting in an increase in the overall height of the cleaning robot 200, and the oversize transversal water storage space 442 may easily lead to the insufficient strength of the bottom of the water tank 400, which may overwhelm obstacles and cause damage. However, if there is no transversal water storage space 442 under the accommodating area R, the capacity of the water tank 400 is relatively reduced. At the same time, the longitudinal water storage space 441 does not increase the height of the water tank 400, and it is not easy to be crushed. Therefore, the cross section width of the transversal water storage space 442 is arranged to be smaller, while the cross section width of the longitudinal water storage space 441 is arranged to be larger, so as to maximize the water storage capacity of the water tank 400.

The formation of the transversal water storage space 442 will be described below. In one embodiment, the water tank 400 includes a bottom plate 401 and a housing 402, as shown in FIG. 5. The housing 402 mounted on the bottom plate 401 and the bottom plate 401 enclose together to form a water storage cavity of the water tank 400. The bottom plate 401 may be a flat plate; or, the bottom plate 401 includes a flat plate and a surrounding plate surrounding the flat plate, and a water storage space above the plate is formed between the flat plate and the surrounding plate; or, the bottom plate 401 is a flat plate, and the upper surface of the flat plate is concave to form a water storage space; or, the bottom plate 401 includes a flat plate and a structural member arranged around the flat plate, and the flat plate and the structural member enclose together to form the water storage space above the flat plate. When the bottom plate 401 is a flat plate, the transversal water storage space 442 is enclosed by the housing 402 mounted on the bottom plate 401. When the bottom plate 401 has its own water storage space, the transversal water storage space 442 is composed of part or all of the water storage space.

Referring to FIG. 4*b*, the bottom plate 401 has a lowest horizontal plane area $Q_1$ corresponding to the accommodating area and an inclined diversion area $Q_2$ adjacent to the lowest horizontal plane area $Q_1$. The water tank 400 comprises a water transporting mechanism 450 arranged in the lowest horizontal plane area $Q_1$ of the bottom plate 401. The water transporting mechanism 450 is communicated with the outlet valve 420 through a pipe, and the water transporting mechanism 450 conveys water to the outlet valve 420. Further, the lowest horizontal plane area $Q_1$ and the accommodating area R are arranged directly opposite to each other. In order to improve the water collection effect, an inclined diversion area $Q_2$ adjacent to the lowest horizontal plane area $Q_1$ is arranged around the lowest horizontal plane area $Q_1$. The inclined diversion area $Q_2$ is used to guide the water of the two main water storage cavities 430 and the secondary water storage cavity 440 to the lowest horizontal plane area $Q_1$, thereby increasing the water collection effect of the water transporting mechanism 450.

Referring to FIG. 3, the orthographic projection area of the secondary water storage cavity 440 in the horizontal direction is larger than the orthographic projection area of the main water storage cavity 430 in the horizontal direction. Under the premise of ensuring the strength of the water tank 400, the water collection area of the main water storage cavity 430 is arranged to be larger to increase the water collection space.

In another embodiment, the horizontal width of the two main water storage cavities 430 gradually decrease toward the direction close to the secondary water storage cavity 440. The horizontal width may be the width in the length direction of the horizontal projection of the water tank 400, or the width in the width direction of the horizontal projection of the water tank 400. Specifically, for example, the horizontal width is the width in the length direction of the horizontal projection of the water tank 400. Please continue to referring to FIG. 3, the main water storage cavity 430 has a width L in the horizontal direction. After the accommodating area R being arranged, the horizontal width of the main water storage cavity 430 gradually decreases towards the direction close to the secondary water storage cavity 440. The arrangement realizes that the accommodating area R has a larger volume, which is conducive to accommodating a larger-volume carrying structure, thus realizing a reasonable match between the water tank 400 and the body 230 of the cleaning robot 200, and effectively ensuring that the water tank 400 has a large enough water storage space.

Figure 6:
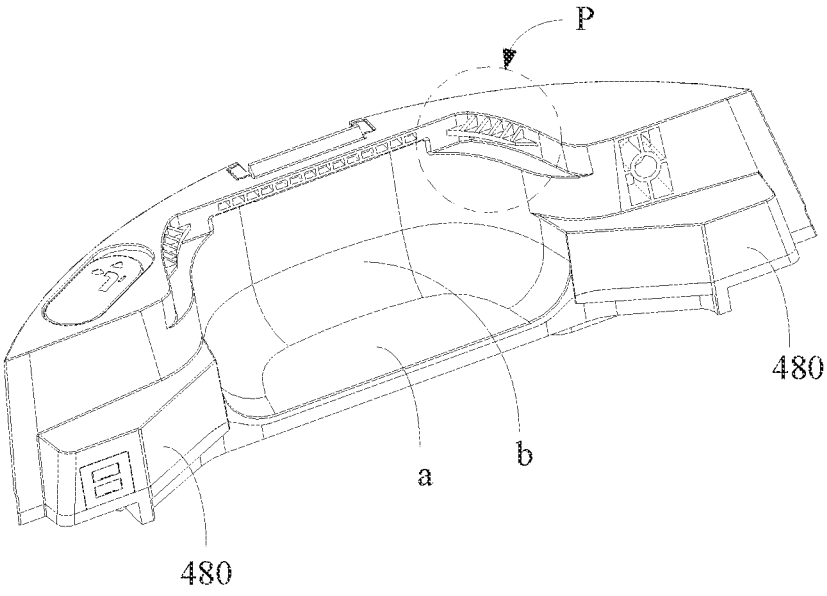
FIG. 6 is a schematic structural diagram of the water tank in FIG. 2.

In another embodiment, please refer to FIG. 6, the accommodating area R has a bottom wall a adjacent to the bottom of the water tank 400, and a side wall b connected to the bottom wall a and extending away from the bottom of the water tank 400. The connection between the bottom wall a and the side wall b is smoothly transited, so that when the water tank 400 is matched with the cleaning robot 200, the contact surfaces between the two are attached more closely. In addition, the corners with smooth transition are easier to de-mold during production.

Further, in order to improve the supporting strength of the bottom wall a, alternatively, a support member is arranged below the bottom wall a. One end of the support member Z is connected to the bottom wall a, and the other end is supported at the bottom of the water tank 400. It could be understood that, with the arrangement of the support member Z, the bottom wall a is supported, which improves the load-bearing capacity of the bottom wall a, and avoids the damage to the bottom wall a when colliding or bearing the weight.

Figure 7:
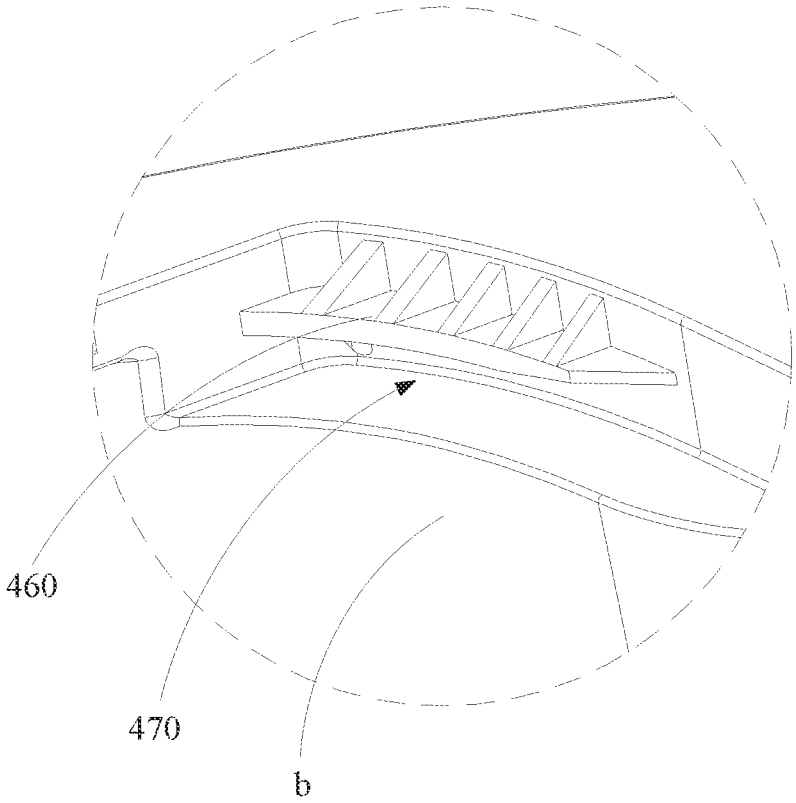
FIG. 7 is an enlarged view of the section P in FIG. 6.

There are no specific limitations on the mounting method and location of the mounting reinforcement part 460. For example, the mounting reinforcement part 460 may be a mounting rib, a mounting strip, a mounting buckle or more. The mounting reinforcement part 460 can be arranged at any position on the water tank 400, or be arranged close to the upper part of the water tank 400. In the present application, the solution is shown in FIG. 6 and FIG. 7. The mounting reinforcement part 460 is provided as a reinforcing rib, and the extending direction of the reinforcement rib should match the moving direction when the water tank 400 is mounted to the cleaning robot 200. The reinforcement ribs are located on the upper part of the water tank 400. After the cleaning robot 200 is mounted on the water tank 400, the reinforcement ribs can not only fix the water tank 400, but also stabilize the upper part of the water tank 400 to prevent the water tank 400 from shaking due to the unstable installation when the cleaning robot 200 is working.

Furthermore, it can save space without affecting the arrangement of the accommodating area R. Therefore, a recessed portion 470 may be arranged on the side wall of the accommodating area R. The recessed portion 470 is close to and penetrates through the splicing side P of the water tank 400, and the mounting reinforcement part 460 is arranged in the recessed portion 470. Alternatively, each of the both sides of the accommodating area R is provided with the recessed portion 470, and each of the two recessed portion 470 is provided with the mounting reinforcement part 460 therein.

Please continue to refer to FIG. 6, in order to facilitate the mounting and cooperation between the water tank 400 and the cleaning robot 200, a guide mounting block 480 is arranged on the splicing side P of the water tank 400, and the guide mounting block 480 plays a guiding role in the mounting of the water tank 400. In addition to the guiding function of the guide mounting block 480, when the water tank 400 is mounted on the body of the cleaning robot 200, the guide mounting block 480 is correspondingly fixed in the mounting groove of the body 230 of the cleaning robot 200 to prevent shaking. In the application, a plurality of guide mounting blocks 480 may be arranged, such as 2, 4, 6 or more. FIG. 6 shows a schematic diagram of an embodiment in which two guide mounting blocks 480 are arranged. The two guide mounting blocks 480 are respectively located on both sides of the accommodating area R, and the two guide mounting blocks 480 are symmetrically distributed.

Further, in order to facilitate the assembly of the guide mounting block 480 and the mounting of the water tank 400, the cross-sectional area of the guide mounting block 480 gradually may decrease in the direction away from the splicing side P of the water tank 400. For example, the guide mounting block 480 is approximately trapezoidal, triangular or semi-elliptical.

The water tank 400 disclosed in the technical solution of the application, comprises a splicing side P provided with an accommodating area R recessed towards the inside of the water tank 400, and the accommodating area R can accommodate part of the structure of the cleaning robot 200 and thus avoid the influence on the structure of the cleaning robot 200. Secondly, the structure beside the accommodating area R of the water tank 400 includes a water storage cavity with a large volume, thereby ensuring the water storage function of the water tank 400. In addition, when the water tank 400 is mounted on the cleaning robot 200, the side surfaces C at both ends of the splicing side P of the water tank 400 smoothly transit to the side surfaces of the body 230 of the cleaning robot 200, so that the overall structure of the combination of the two has an integrated, compact and beautiful appearance.

The above descriptions are only the exemplary embodiments of the present disclosure and do not limit the scope of the present disclosure. Under the disclosure concept of the disclosure, the equivalent structure transformation made by using the description and the attached drawings of the disclosure, or directly/indirectly applied in other related technical fields, is included in the scope of the patent protection of the disclosure.

What is claimed is:

1. A water tank, applied to a cleaning robot, internally provided with a water storage cavity, wherein the water tank has a splicing side, the splicing side is provided with an accommodating area recessed towards an inside of the water tank, the splicing side of the water tank is configured to splice with a body of the cleaning robot; and the accommodating area is configured to accommodate part of structural parts of the body of the cleaning robot, wherein the part of the structural parts of the body is a carrying structure of the body;

wherein the water tank comprises a bottom plate and a housing, wherein the housing is mounted on the bottom plate and the accommodating area is formed by partly recessing of the housing;

wherein a water storage space is formed above the bottom plate, and the water storage space of the bottom plate and a cavity of the housing enclose together to form the water storage cavity of the water tank;

wherein the bottom plate has a lowest horizontal plane area corresponding to the accommodating area and an inclined diversion area adjacent to the lowest horizontal plane area, and the water tank comprises a water transporting mechanism arranged in the lowest horizontal plane area of the bottom plate, wherein the lowest horizontal plane area and the accommodating area are arranged directly opposite to each other, and the lowest horizontal plane area is under the accommodating area;

wherein the water storage cavity of the water tank comprises two main water storage cavities on opposite sides of the accommodating area, and a secondary water storage cavity corresponding to the accommodating area and communicating with the two main water storage cavities, wherein the two main water storage cavities are on opposite sides of the secondary water storage cavity;

wherein a water storage space of the two main water storage cavities is larger than a water storage space of the secondary water storage cavity;

wherein the secondary water storage cavity comprises a longitudinal water storage space and a transversal water storage space, the longitudinal water storage space is at a back side of the accommodating area, the transversal water storage space is at a bottom side of the accommodating area, and a cross-sectional area of the longitudinal water storage space is larger than a cross-sectional area of the transversal water storage space;

wherein the water transporting mechanism is communicated with an outlet valve through a pipe, and the water transporting mechanism conveys water to the outlet valve.

2. The water tank according to claim 1, wherein a top of the accommodating area is open.

3. The water tank according to claim 2, wherein the accommodating area has a bottom wall adjacent to a bottom of the water tank and a side wall extending away from the bottom of the water tank from the bottom wall, wherein a connection between the bottom wall and the side wall is smoothly transited.

4. The water tank according to claim 3, wherein a support member is connected below the bottom wall and supports the bottom of the water tank.

5. The water tank according to claim 3, wherein a recessed portion is arranged at a position of the side wall close to the splicing side, wherein the recessed portion penetrates the splicing side of the water tank, and a mounting reinforcement part is arranged in the recessed portion.

6. The water tank according to claim 1, wherein a horizontal width of the two main water storage cavities gradually decrease in a direction towards the secondary water storage cavity.

7. The water tank according to claim 1, wherein an orthographic projection area of the secondary water storage cavity in a horizontal direction is greater than a orthographic projection area of one of the two main water storage cavities in the horizontal direction.

8. The water tank according to claim 1, wherein the splicing side of the water tank is further provided with a guide mounting block, wherein the guide mounting block is configured to guide the water tank to splice and match with the body of the cleaning robot.

9. The water tank according to claim 8, wherein each of both sides of the accommodating area is provided with the guide mounting block and the two guide mounting blocks are symmetrically distributed.

10. The water tank according to claim 8, wherein a cross-sectional area of the guide mounting block gradually decreases in a direction towards the accommodating area of the water tank.

11. The water tank according to claim 1, wherein the longitudinal water storage space is a three-dimensional space extending along a height direction of the water tank, and the transversal water storage space is a three-dimensional space extending along a width direction of the water tank, so as to increase a volume of the water tank.

12. A cleaning robot, comprising:

a body, and a water tank, applied to the cleaning robot, internally provided with a water storage cavity, wherein the water tank has a splicing side, the splicing side is provided with an accommodating area recessed towards the inside of the water tank, the splicing side of the water tank is configured to splice with the body of the cleaning robot; and the accommodating area is configured to accommodate part of structural parts of the body of the cleaning robot, wherein the part of the structural parts of the body is a carrying structure of the body;

wherein the water tank comprises a bottom plate and a housing, wherein the housing is mounted on the bottom plate and the accommodating area is formed by partly recessing of the housing;

wherein a water storage space is formed above the bottom plate, and the water storage space of the bottom plate and a cavity of the housing enclose together to form the water storage cavity of the water tank;

wherein the bottom plate has a lowest horizontal plane area corresponding to the accommodating area and an inclined diversion area adjacent to the lowest horizontal plane area, and the water tank comprises a water transporting mechanism arranged in the lowest horizontal plane area of the bottom plate, wherein the lowest horizontal plane area and the accommodating area are arranged directly opposite to each other, and the lowest horizontal plane area is under the accommodating area;

wherein the water tank is spliced with the body of the cleaning robot;

wherein the water storage cavity of the water tank comprises two main water storage cavities on opposite sides of the accommodating area, and a secondary water storage cavity corresponding to the accommodating area and communicating with the two main water storage cavities, wherein the two main water storage cavities are on opposite sides of the secondary water storage cavity;

wherein a water storage space of one of the two main water storage cavities is larger than a water storage space of the secondary water storage cavity;

wherein the secondary water storage cavity comprises a longitudinal water storage space and a transversal water storage space, the longitudinal water storage space is at a back side of the accommodating area, the transversal water storage space is at a bottom side of the accommodating area, and a cross-sectional area of the longitudinal water storage space is larger than a cross-sectional area of the transversal water storage space;

wherein the water transporting mechanism is communicated with an outlet valve through a pipe, and the water transporting mechanism conveys water to the outlet valve.

13. The cleaning robot according to claim 12, wherein the cleaning robot further comprises a mopping assembly, a water pumping device and a fluid applicator;

the mopping assembly is detachably connected to a bottom of the water tank; and the water pumping device can pump a liquid in the water storage cavity to the fluid applicator, and the fluid applicator divides the liquid to a plurality of areas on the mopping assembly.

14. The cleaning robot according to claim 12, wherein a top of the accommodating area is open.

15. The cleaning robot according to claim 12, wherein the longitudinal water storage space is a three-dimensional space extending along a height direction of the water tank, and the transversal water storage space is a three-dimensional space extending along a width direction of the water tank, so as to increase a volume of the water tank.

* * * * *